United States Patent [19]

Turner

[11] Patent Number: 4,503,652

[45] Date of Patent: Mar. 12, 1985

[54] BRACING ELEMENT

[76] Inventor: Arthur R. Turner, 69 Terranora Rd., Banora Point, Near Tweed Heads, New South Wales, Australia

[21] Appl. No.: 417,181

[22] Filed: Sep. 13, 1982

[30] Foreign Application Priority Data

Oct. 21, 1981 [NZ] New Zealand ..... 198727

[51] Int. Cl.[3] ..... E04C 3/292

[52] U.S. Cl. ..... 52/657; 52/632; 52/726; 52/732; 52/693; 52/741

[58] Field of Search ..... 52/657, 149, 632, 731, 52/693, 720, 726, 730, 732, 695

[56] References Cited

U.S. PATENT DOCUMENTS 3,875,719 4/1975 Menge ..... 52/657 X
3,914,914 10/1975 Jureit et al. ..... 52/632
4,038,710 8/1977 Tambascio ..... 52/632
4,157,002 6/1979 Adolph ..... 52/657
4,281,487 8/1981 Koller ..... 52/731 X

*Primary Examiner*—J. Karl Bell
*Attorney, Agent, or Firm*—Dressler, Goldsmith, Shore, Sutker & Milnamow, Ltd.

[57] ABSTRACT

A bracing element comprises a pair of metal members 1A' and 1A" which have respective cross-sectional shapes which approximate one another and which enable one member 1A' to be retained and accommodated in a slidable nested relationship with the other member 1A" so that relative movement of the members 1A' and 1A" can telescope the members so as to extend the overall length of the bracing element. In another embodiment the inner of the two members has part of its cross-sectional shape compressed so that the compressed portion can be slidably accommodated within the uncompressed cross-sectional shape of the outer of the two members.

5 Claims, 6 Drawing Figures

BRACING ELEMENT

BACKGROUND OF THE INVENTION

This invention relates to bracing elements for use in building construction.

It is known to provide steel bracing for use in timber framed walls. In general these existing braces are either of the "angle brace" type or the "T brace" type and require saw cuts to be provided in the studs of the timber framing into which the bracing is inserted prior to nailing.

In areas subject to cyclones the use of saw cuts in any framing member may be contrary to existing building regulations and in such areas a strap type brace will instead generally be used although being a purely tension brace a pair of such strap braces, diagonally opposed, are required.

Whatever type of brace is used in a particular framing the braces will generally have to accommodate various angles and suit various length requirements. Also most "angle braces" must be inherently strong enough in compression to withstand racking forces and at least at equal strength as timber bracing and for this reason 18 gauge metal can customarily be used.

In the United States of America heavier types of flat strap braces made out of 14 or 12gauge metal are customary but again these have to be used in pairs. Where "angle braces" have been used in the United States of America objection has been raised that as the framing is usually plumbed for vertical on site when the frame is in its erected state, the nailing home of the brace necessitates the use of a saw stool to nail it onto the top plate of the framed wall and generally the first stud, the subsequent nailing after plumbing generally being able to be reached from ground level.

SUMMARY OF THE INVENTION

Having regard to the above mentioned difficulties concerned in the use of existing bracing elements the present invention has as an object thereof the provision of a bracing element which can go at least some way to obviate such difficulties and to provide a speedy and efficient bracing in a building construction.

Accordingly one embodiment of the present invention thus provides a bracing element comprising at least a pair of elongate members having respective cross-sectional shapes approximating one another which can resist axial loading, wherein one of said members can be accommodated and retained in a slidable nested relationship with the other of said members whereby relative movement of the said members can extend the overall length of the bracing element.

According to a further embodiment of this invention there is provided a method of constructing a building frame using the bracing element above defined wherein one of said bracing members is secured to one extremity of the frame and another of said members of the bracing element, expanded to the required length, is secured to a second extremity of the frame, the bracing members then being slid relative one with the other during the plumbing or squaring of the frame to enable overlapping of the bracing members at the frame members and the securement of the bracing element to the frame members through the said overlapping.

According to a still further embodiment of the invention there is provided a method of forming a bracing element having an overall length which can be extended or contracted, said method comprising:

(a) forming a pair of elongate members each having substantially the same cross-sectional shape which can resist axial loading, (b) compressing at least one end of at least one of said members along a predetermined length such that said compressed portion of said one of said members can be slidably accommodated within an uncompressed end of the other of said members.

According to yet a further embodiment of the invention there is provided a bracing element comprising at least a pair of elongate members having substantially the same cross-sectional shapes which can resist axial loading, at least one of said members at at least one end thereof being compressed along a predetermined length to enable said compressed portion to be retained in a slidable nested relationship with an uncompressed end of the other of said members over said predetermined length to extend or contract the overall length of the bracing element.

According to a further embodiment of the invention there is provided a method of bracing a building frame using the bracing element as defined immediately above wherein one of said bracing members is secured to one extremity of the frame and another of said members of the bracing elements, expanded to the required length, is secured to a second extremity of the frame, the bracing members then being slid relative one with the other during the plumbing or squaring of the frame to enable overlapping of the bracing members at the frame members and the securement of the bracing element to the frame members through the said overlapping.

BRIEF DESCRIPTION OF THE DRAWINGS

Various embodiments of the present invention will now be described by way of example and with reference to the accompanying drawings wherein.

The present invention broadly resides in the provision of a bracing element comprising at least a pair of slidable bracing members which can be slid from a nested relationship when an increase in the overall length of the bracing element is required. For this purpose the two or more nested members are of cross-sectional shapes which approximate one another with appropriate scaling down of the inner member of a nested pair where appropriate.

In some embodiments of the present invention the bracing elements are of the type where a stem of a T-shaped element or a side of an angle-type element is inserted into the saw cuts provided in a timber framing prior to the exposed portions of the bracing element as it crosses over the timber framing being nailed thereto.

In other embodiments of the invention the bracing elements are of the type which can be flattened as they cross the timber framing and are secured thereto so as to minimize the planar disruption of the timber framing.

In a particular embodiment of the invention the slidable and nested relationship of the bracing element is achieved by a single roll former.

DESCRIPTION OF THE PREFERRED EMBODIMENTS

Figure 1:
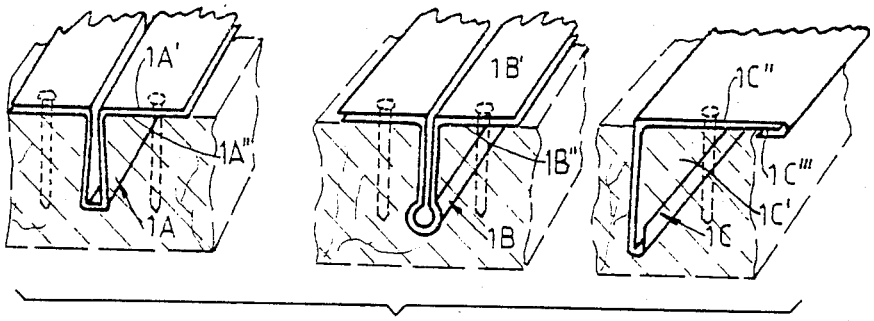
FIG. 1 shows, diagrammatically, cross-sectional views of alternative forms of bracing elements according to various embodiments of the present invention with each bracing element disposed in a timber frame that is illustrated in phantom by dashed lines.
Figure 2:
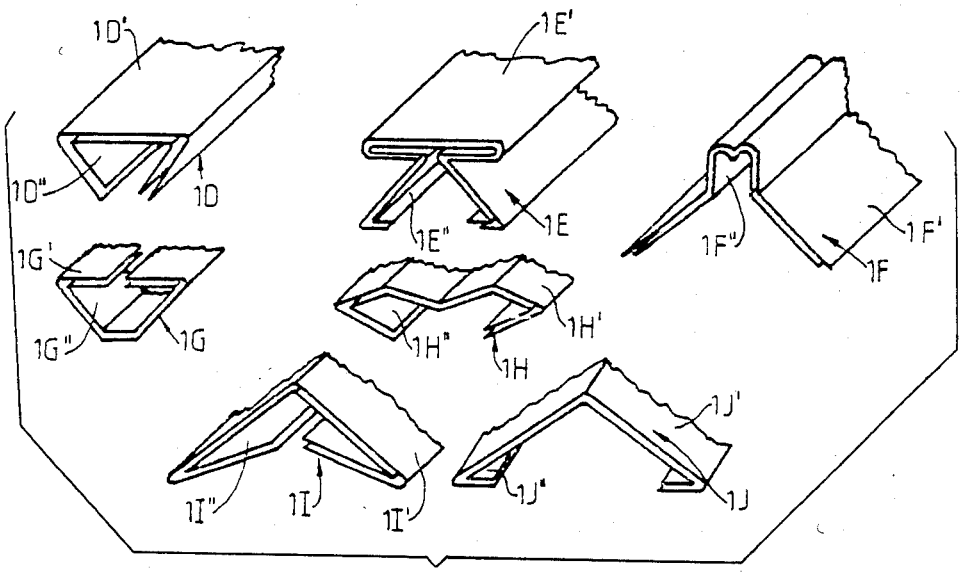
FIG. 2 shows, diagrammatically, cross-sectional views of bracing elements according to various other embodiments of the present invention.
Figure 3:
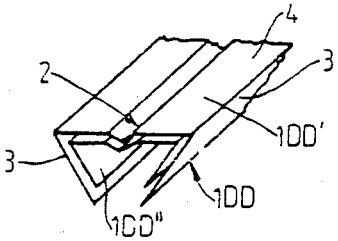
FIG. 3 shows, diagrammatically, a cross-sectional view of a bracing element according to a still further embodiment of the invention.

Referring to FIGS. 1 to 3 of the accompanying drawings reference will first be made to FIG. 1 thereof in which various embodiments of the first above mentioned type of bracing element are shown.

Thus bracing element 1A is shown comprising a pair of T-shaped bracing members 1A' and 1A" in a slidable and nested relationship the respective stems of which being able to be inserted into saw cuts provided in a timber framing and additional securement by means of nailing through its flanges and/or through its stem being effected if required. The respective stems of the bracing members 1A' and 1A" are shown of a substantially wedge-shape with the smaller dimensions or resilience of the "inner" member 1A' enabling the sliding and wedging relationship with the "outer" member 1A".

Similarly with the bracing element 1B, inter-engaged stems and beads of respective bracing members 1B' and 1B" enable a sliding and nesting relationship between the two members.

Referring now to bracing element 1C the "inner" member 1C' and the "outer" member 1C" are both shown of a substantially angle cross-sectional shape with the member 1C' having at its free ends inturned edges 1C'" to provide channels in which the respective free edges of the inner member 1C' can slide or be nestably accommodated.

In these embodiments shown in FIG. 1 in each case the stem or angle of the respective member would be inserted into the saw cuts provided in the timber framing prior to nails or screws being used to secure the bracing to the framing. In the embodiments 1A and 1B, nails may be through the respective stems and/or the respective flanges.

Referring now to the embodiments shown in FIG. 2 the bracing elements 1D, 1E, 1F, 1G, 1H, 1I and 1J are shown including respective pairs of bracing members 1D', 1D"; 1E', 1E"; 1F', 1F"; 1G', 1G"; 1H'; 1H",1I',1I", 1J', 1J"; which are in a slidable and nestable relationship one with the other. Where appropriate the "inner" member of each pair may be appropriately scaled down dimensionally so as to facilitate the nesting and slidable relationship.

Each of the embodiments shown in FIG. 2 are of the second type of bracing element above mentioned where, as the bracing element passes over the members of the timber framing, it can be flattened thereagainst to thus minimize the planar disruption of the timber framing by the said element. At these crossing points nails can then be secured through the bracing members 1D', 1D" etc. to secure the bracing elements 1D' etc. to the framework.

Referring to FIG. 3 a modified form of the bracing element 1D of FIG. 2 is shown and referenced generally by arrow 1DD. The element 1DD is shown having an outer member 1DD' and nested therein in slidable relationship therewith an inner member 1DD". The respective top surfaces 4 of the members are shown provided with a substantially central nailing groove 2 through which nails or screws can be driven to extend through the gap defined by the bottom edges of the respective side walls 3. between the members 1DD' and 1DD" the outer member may have an increase in the width of its upper surface 4 by an amount of for example 8 to 9%.

In being able to expand, all embodiments of the present invention will enable the bracing element to be lengthened to a required length to enable it to be nailed to the top and bottom plates of the wall and the wall can be squared either on the ground or when erected. In the latter case the expansion or contraction of the bracing element will allow the squaring prior to the nailing of the bracing members as they cross over the wall studs. At the over lapping of two brace members along the length of the bracing element additional nailing should be effected. A suitable overlap, arranged so as to occur at a stud crossing, may be of the order of 6 inches or so. It will be seen that with two bracing members each of 6 foot lengths nested within one another, at maximum extension a bracing element having an overall length of 11 foot 6 inches can be provided.

By providing additional lengths of bracing members these can be added end to end to form a continuous brace for roofs, ceilings etc. such that if required a bracing element of a forty or fifty foot length can result.

In the embodiments of the invention shown in FIGS. 2 and 3 as the bracing element does not check in to the timber framing it will enable cyclonic area requirements to be met and whilst being both a compression and tension brace it can be of a relatively light metal e.g. 26 gauge galvanized which it will be appreciated is three times thinner and lighter than 18gauge angle brace. The lightness of the above mentioned gauge of metal if used would make it easier to nail through although if heavier metal were used nail holes may be provided or alternatively built-in nails which can protrude when the brace is flattened and the brace nailed home.

One additional advantage of the extendible nature of the embodiments of the present invention is that a single nail placed in the middle on the lapped portion of the brace on a stud will act as a temporary brace for transportation of a wall framing.

The bracing element of the present invention can be used in single form for dog leg bracing as used around windows or for full height can be expanded as required.

It will be appreciated in this regard that the bracing elements of the present invention could be used unexpanded in multi-storey buildings as two bracing members one inside the other will double its strength.

It will further be appreciated in respect of the embodiments shown in FIGS. 2 and 3 that with certain gauges of material there may be difficulty in ensuring that the top level of the bracing does not protrude above the level of the surface of the framing to thus interfere with the wall lining secured thereover. This problem is of course due to the strength of the creases that have to collapse over the studs. However a solution has been found with the heavy scoring, prefolding and- /or creasing of the brace material before it is formed e.g. roll formed. This has the effect of providing weakening lines or creases enabling the bracing element when formed to be substantially completely flat when it crosses the stud.

In achieving the nested and sliding relationship between the members of the composite bracing element of the embodiments of FIGS. 1 to 3 of the accompanying drawings two roll formers could be necessary one to produce the male section and one to produce the female section.

In the embodiment of the invention hereinafter described in respect of FIGS. 4 to 6 of the accompanying drawings however this slidable and nested relationship can be achieved by only a single roll former.

Figure 4:
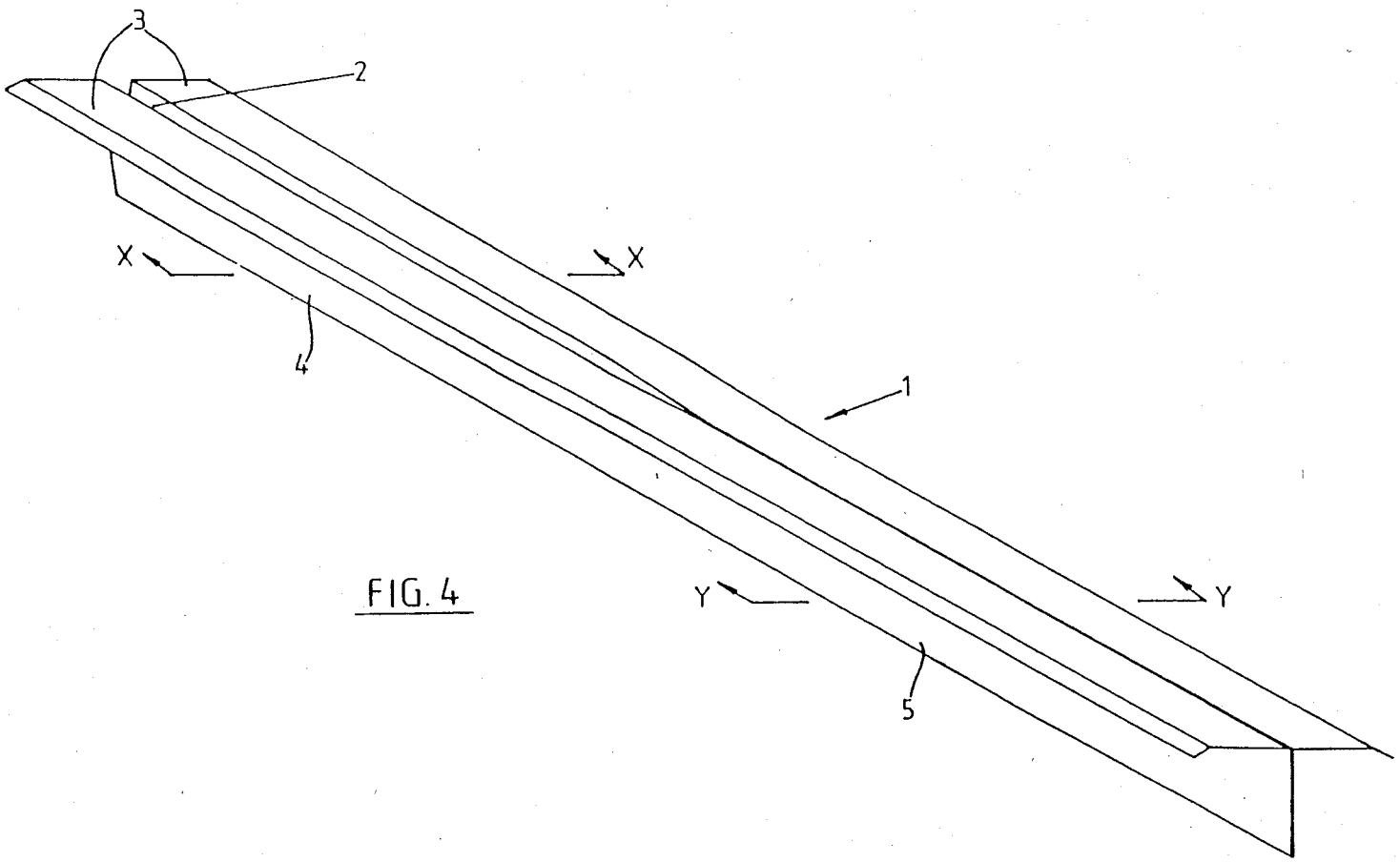
FIG. 4 shows a foreshortened view of one of a pair of nestable and slidable bracing members of a bracing element according to yet a further embodiment of the invention with the timber frame omitted for ease of illustration but with the omitted timber frame being illustrated in FIGS. 5 and 6 as described hereinafter.
Figure 6:
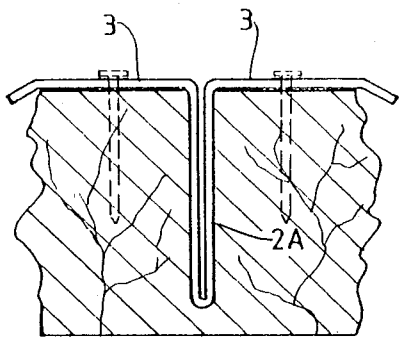
FIG. 6 shows a cross-sectional view along arrows Y—Y of FIG. 4 with the timber frame that was omitted from FIG. 4 being shown in cross section in this Figure.
Figure 5:
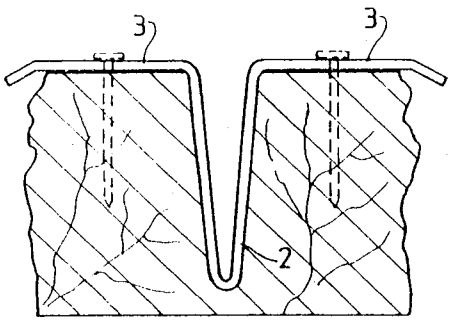
FIG. 5 shows a cross-sectional view along arrows X—X of FIG. 4 with the timber frame that was omitted from FIG. 4 being shown in cross section in the Figure.

Thus, referring to FIGS. 4 to 6 of the accompanying drawings one of a pair of bracing members 1 of an expandible bracing element is shown of a substantially "T" shape with a stem 2 and side webs or flanges 3.

The overall length of each bracing member 1 may for example be of the order two meters and a major portion 4 of its length may be roll formed and left with an open stem portion 2 as shown in FIG. 4. An end portion 5 may however, as it leaves the roll former and is quillotined, be automatically compressed so that the stem portion is compressed as indicated by the stem portion 2A shown in FIG. 6.

It will be seen therefore that in this way a single roll former can produce a standard bracing member 1, a pair of which having substantially identical cross-sectional shapes are able to be nested together and slid to provide an adjustment of the overall length of the composite bracing element so formed.

Thus the compressed stem 2A of portion 5 of one membe can be inserted into the open stem 2 of portion 4 of a second bracing member 1 and be capable of being slid therealong.

While a length of 300 mm for portion 5 may be suitable it is envisaged that probably only about 100 mm of slidable adjustment at the most may in fact be required.

It is to be appreciated that compression of at least part of at least one of a pair of bracing members required to have a nested and slidable relationship along a predetermined length may be applied to bracing members of any suitable cross-sectional shape not necessarily the "T" shape shown. Moreover whilst the compression may suitably be in conjunction with a quillotining operation, such compression may be achieved by any other suitable method or means such as by a suitable die.

Where in the aforegoing description reference has been made to specific components or integers of the invention having known equivalents then such equivalents are herein incorporated as if individually set forth.

Thus, whilst metal of suitable gauge to provide the necessary axial strength is preferred other suitable material may be utilized. Furthermore whilst reference has been made particularly to the construction of wall frames it is equally applicable to other building frames such as those of roofs and wherever resistance to wracking is required.

Although this invention has been described by way of example and with reference to possible embodiments thereof it is to be understood that modifications or improvements may be made thereto without departing from the scope of the invention as defined in the appended claims.

I claim:

1. A bracing element for a timber building frame comprising a pair of nailable elongate members having respective open cross-sections approximating one another capable of resisting axial loading in both directions sufficient to stabilize the timber building frame, one of said members being accommodated and retained in a slidable nested relationship with the other of said members whereby relative movement of the said members extends or contracts the length of the bracing element during installation to suit the plumbing or squaring of the timber frame.

2. A method of forming a bracing element for a timber wall frame construction the length of which element can be extended or contracted during installation to suit the plumbing or squaring of the timber frame, said method comprising:

(a) forming a pair of elongate nailable members each having substantially identical open cross-sections capable of resisting axial loading in both directions sufficient to stabilize the timber frame; and (b) compressing a predetermined length of at least one end of one of said members such that said compressed length can be slidably accommodated within the uncompressed end of the other of said members.

3. A bracing element for a timber wall frame construction comprising at least a pair of elongate nailable members each having substantially identical open cross-sections capable of resisting axial loading in both directions sufficient to stabilize the timber frame, one of said members being compressed at least at one end thereof along a predetermined length whereby said compressed length can be retained in a slidable nested relationship with the uncompressed end of the other of said members over said predetermined length to extend or contract the overall length of the bracing element during installation to suit the plumbing or squaring of the timber frame.

4. A bracing element as claimed in claim 3 wherein each member is fabricated from steel and has a substantially T-shaped cross-section with the stem of said one of said members being compressed for said predetermined length so as to have said slidable nested relationship along said predetermined length with the uncompressed stem of the other of said members.

5. In a timber wall frame construction including a nailable bracing element let into saw cuts therein or flattened there against and having nails fastening it to members of said wall frame, the improvement comprising; a bracing element formed from a pair of elongate nailable members each having substantially identical open cross-sections capable of resisting axial loading in both directions and sufficient to stabilize the timber frame, one of said members being compressed at one end thereof along a predetermined length, said compressed length having a slidable nested relationship with the uncompressed end of the other of said members to extend or contract the overall length of the bracing element during installation to suit the plumbing or squaring of the timber frame before being nailed thereto.

* * * * *